US005799476A

United States Patent [19]

Bahlmann

[11] Patent Number: 5,799,476

[45] Date of Patent: Sep. 1, 1998

[54] SPINNING STATION ERROR SIGNALLING AND QUALIFYING DEVICE

[75] Inventor: Bernd Bahlmann, Schrobenhausen, Germany

[73] Assignee: Rieter Ingolstadt Spinnereimaschinenbau AG, Ingolstadt, Germany

[21] Appl. No.: 768,341

[22] Filed: Dec. 17, 1996

Related U.S. Application Data

[63] Continuation of Ser. No. 319,499, Oct. 7, 1994, abandoned.

[30] Foreign Application Priority Data

Oct. 18, 1993 [DE] Germany ..... 43 35 459.9

[51] Int. Cl.[6] ..... D01H 7/46; D01H 7/92

[52] U.S. Cl. ..... 57/264; 57/263; 57/301; 57/400

[58] Field of Search ..... 57/264, 265, 301, 57/400, 263

[56] References Cited

U.S. PATENT DOCUMENTS

| | | | |
|---|---|---|---|
| 3,303,698 | 2/1967 | Loepfe . | |
| 4,005,392 | 1/1977 | Akatsuka et al. . | |
| 4,047,371 | 9/1977 | Stahlecker | 57/301 |
| 4,056,926 | 11/1977 | Stuber | 57/264 |
| 4,167,041 | 9/1979 | Curlander et al. . | |
| 4,246,748 | 1/1981 | Artzt et al. | 57/264 |
| 4,294,065 | 10/1981 | Lane . | |
| 4,408,447 | 10/1983 | Sloupensky et al. . | |
| 4,491,831 | 1/1985 | Sakai et al. | 57/264 |
| 4,534,042 | 8/1985 | Marsicek et al. . | |
| 4,563,873 | 1/1986 | Tooka . | |
| 4,656,465 | 4/1987 | Erni et al. . | |
| 4,666,096 | 5/1987 | Heel et al. . | |
| 4,817,381 | 4/1989 | Meissner | 57/264 |
| 4,817,425 | 4/1989 | Ueda et al. | 57/264 |
| 4,823,544 | 4/1989 | Igel | 57/265 |

(List continued on next page.)

FOREIGN PATENT DOCUMENTS

| | | |
|---|---|---|
| 448836 | 4/1968 | Czechoslovakia . |
| 0026111 | 4/1981 | European Pat. Off. . |
| 0153350 | 11/1987 | European Pat. Off. . |
| 0419827A2 | 4/1991 | European Pat. Off. . |
| 0432401A2 | 6/1991 | European Pat. Off. . |
| 2098414 | 3/1972 | France . |
| 1907990 | 11/1969 | Germany . |
| 1800434 | 5/1970 | Germany . |
| 3135333A1 | 3/1983 | Germany . |
| 3701796A1 | 8/1988 | Germany . |
| 3928417A1 | 3/1990 | Germany . |
| 3841464A1 | 6/1990 | Germany . |
| 3940923A1 | 6/1991 | Germany . |
| 4019957A1 | 8/1991 | Germany . |
| 4012930A1 | 10/1991 | Germany . |

(List continued on next page.)

OTHER PUBLICATIONS

Qualitats–Sicherung und Garnreinigung An OE–Rotor–Spinnautomaten, Dr. B. Hammer, Wollerau/Schweiz, Dec., 1984.

Melliand Textilberichte, Apr., 1973, pp. 331–334.

Melliand Textilberichte, Aug. 1988, pp. 548–553.

*Primary Examiner*—William Stryjewski
*Attorney, Agent, or Firm*—Dority & Manning

[57] ABSTRACT

In order to increase the operating efficiency of the spinning machine and in order to generate a response suitable to the hierarchy or quality of the error message in case of an error in the yarn or in another electrical or mechanical device of the spinning machine, the parameter signal of the yarn obtained by a measuring device (20) is transmitted to an evaluating phase (21,22) which emits error message signals. These are attributed in an attribution section (23) to predefined error groups (A,B,C,D). Each one of the output signals of the attribution section represents a group of errors and generate (automatically) graduated responses for the elimination of errors.

17 Claims, 1 Drawing Sheet

U.S. PATENT DOCUMENTS

| | | | |
|---|---|---|---|
| 4,835,699 | 5/1989 | Mallard . | |
| 4,965,567 | 10/1990 | Meyer . | |
| 5,224,047 | 6/1993 | Kitgagwa et al. | 57/264 |
| 5,347,449 | 9/1994 | Meyer et al. . | |
| 5,386,684 | 2/1995 | Simon et al. . | |
| 5,440,870 | 8/1995 | Neumann | 57/265 |

FOREIGN PATENT DOCUMENTS

| | | | |
|---|---|---|---|
| 448836 | 4/1968 | Switzerland . | |
| 661913 | 8/1987 | Switzerland . | |
| 1205823 | 9/1970 | United Kingdom . | |
| 1347541 | 2/1974 | United Kingdom . | |
| 2001429 | 1/1979 | United Kingdom . | |
| 2109020 | 5/1983 | United Kingdom | 57/264 |

SPINNING STATION ERROR SIGNALLING AND QUALIFYING DEVICE

This is a continuation of application Ser. No. 08/319,499, filed Oct. 7, 1994, which was abandoned upon the filing hereof.

BACKGROUND OF THE INVENTION

The present invention relates to a device for the signalling and qualifying of errors, and thereby also to a device for the attribution of certain error messages. The invention also relates to a process for the detection and evaluation of occurring errors at a spinning station of a spinning machine.

Modern spinning machines operate essentially automatically and at particularly high speeds. A plurality of individual spinning stations (spin boxes) are aligned in a row and produce a pre-set yarn independently of each other from a fiber sliver fed separately to each station. For this purpose, the fiber sliver is opened by means of an opener roller and the opened fibers are guided by an air stream into a rotor which rotates at very high speed. At the rotor the fibers are collected in a fiber collection groove so that a yarn of a thread may be withdrawn approximately at the center from the conical rotor open on one side, the yarn or thread being guided via deflection pulleys or rollers and possibly to a traversing device in order to be wound up on a bobbin. In order to ensure the quality of the withdrawn yarn, it is necessary to ascertain and to evaluate the quality of the yarn as quickly as possible. For this, a measuring device (measuring head) is provided as a rule, and is located between the yarn withdrawal point and the winding bobbin in the course of the yarn.

Because of the high speed, it is necessary to utilize a rapid error recognition system in order to judge a yarn error rapidly. The speed of error recognition must, however, not be accompanied by an increased number of stoppages because of erroneously recognized "errors" in the yarn. Swiss patent 448 836 also deals with this situation, intending to recognize the irregularities of a yarn and providing two "groups" for this, whereby the first group comprises the natural, purely statistical fluctuations of the number of fibers in a yarn and the resulting fluctuation of yarn cross-section while the second group is the "actual group of irregularities" which are designated as actual yarn errors. The Swiss patent mentions as an example foreign bodies in the yarn such as husks, wood particles or bast fibers. It also mentions machine errors, out-of-round drawing rollers, or irregularities due to operator errors such as dirty piecing joints and dust particles (fly) spun into the yarn. To distinguish the first from the second group, the Swiss patent proposes the application of two criteria, i.e. yarn thickness and length dimension. By adding the length dimension, short, relatively thick errors which are actually not very bothersome, are not recognized as error group 2 but are attributed to error group 1. If, however, long yarn segments with a diameter only slightly above average are spun, these are sensible errors so that they are attributed to the basically substantial error group 2.

OBJECTS AND SUMMARY OF THE INVENTION

It is therefore a principal object of the invention, among other things, not only to distinguish between an actual error and an insignificant "error", but also to emit an error message and qualification at a spinning station which informs comprehensively and precisely on the current status, or even better, on the error which has just occurred. Additional objects and advantages of the invention will be set forth in part in the following description, or may be obvious from the description, or may be learned through practice of the invention.

The objects are attained by the invention whose characteristic features are an error signalling and qualifying device and a detection and evaluation process.

The invention recognizes that it is not enough to report only an error or no error. It immediately carries out an attribution of the occurring and recognized error, and this attribution enables it to determine certain error groups which require individual handling of the occurred error. It is thus possible to ensure that each error only triggers the response that is appropriate for its type. If it is a particularly serious error, e.g. a defect in a measuring device, the spinning station must be shut down. If the error is found in the stationary thickness of the yarn, for example, which cannot be eliminated by rapid automatic intervention (travelling carriage) or which the latter has attempted unsuccessfully to eliminate, the spinning station can be blocked so as to remain basically operational, but so as to carry out its operation only when the error of this category has been eliminated by an operator. In blocking, a yarn breakage is provoked and this spinning station is closed to the travelling carriage. Finally, a less serious yarn error, e.g. a brief fluctuation of yarn thickness, can cause the spinning station to be stopped, whereby a yarn breakage is provoked (artificially) in order to piece a new thread by means of a travelling carriage. There finally exists the possibility of defining a group of errors which only has a message hierarchy; the occurring "error" is only reported by means of a printer or by means of a display device, but production is not stopped at this spinning station.

These four examples of error groups: shut-down of the spinning station; blocking of the spinning station; stopping the spinning station; or message/warning concerning that spinning station are examples of possible hierarchies which are defined and designed individually according to the invention. For this purpose, the invention provides for an attribution section which carries out the qualifying evaluation of the yarn errors measured by the evaluation phase by means of the measuring device. In addition to the yarn errors, error signals caused by the electronics or mechanical system and which cannot be measured via the yarn thickness but are signalled to the attribution section by means of separate measuring signals may also be included in the error groups.

The invention can be used in such a manner that a fixed attribution of certain errors (malfunctions, statistical yarn errors, brief yarn deviations) are attributed to specific error groups with a specific message hierarchy; these are the so-called default settings which can be preset at the factory. In addition, the invention can also work with variable attributions, making it possible to adapt the spinning machine with its plurality of spinning station individually. The adaptation of the spinning machine which has been preset at the factory can be made available to the customer, the machine being adapted to the individual situation in which the spinning machine operates (user-specific). A modification may also be dependent on certain structural configurations of the spinning machine and be influenced by special wishes which are built into a user-specific machine (machine-specific). There is finally the possibility of changing the error groups in a plant-specific manner, i.e. as a function of the machines manner of operating at the installation site in the yarn spinning plant. This implements a feature of the invention, which raises a given error within a hierarchy when this error cannot be eliminated by the assigned person, by the assigned automatic carriage, or by simply cutting and piecing the yarn.

Thus, the invention provides substantially more than the comprehensive and precise information on the state of operation and the currently occurring error. By qualifying these errors, the invention makes it possible to eliminate errors much more rapidly through elimination of incidents because the "competent entity" for each group, the spinning operator, the travelling carriage, the mechanical engineer, the electronics engineer or the operations center can be informed immediately and directly—without prior consideration or decision by an operator. The time during which a spinning station or a spinning section or even the entire machine is stopped can thus be reduced considerably so that the efficiency of the spinning machine is improved considerably by the invention.

The possibility furthermore exists of carrying out a subgrouping within one error group, e.g. for certain yarn errors, in addition to the direct error-source elimination applied to a specific error of an error group.

Finally, the invention can also be used for statistical purposes in order to prepare a report over a long period of time on the spinning machine concerned, with its errors classified into groups, in order to obtain reliable information on the more frequent sources of error and to be able to deal with these sources of error in a purposeful manner applied to this user-specific machine. Maintenance time and consequential costs can therefore be lowered.

As a parameter to be measured in order to detect the yarn errors, the measuring of yarn thickness d(t) is primarily proposed; but added to this may also be such parameters as yarn length, for example.

The attribution section, in addition to the message signals for yarn errors, may be transmitted one or more signals of the spinning machine or the spinning station or of a spinning station section, from their respective mechanical or electronic systems. As an example of this, the monitoring signals of the measuring sensor to measure thickness d(t) or speed signals for fiber intake and/or yarn withdrawal, the functioning or values of which can be monitored electronically, should be mentioned.

An example of the invention will facilitate its understanding.

BRIEF DESCRIPTION OF THE DRAWINGS

The sole FIGURE is a partial schematic and diagrammatic representation of the present invention.

DETAILED DESCRIPTION OF THE PREFERRED EMBODIMENT

Figure 1:
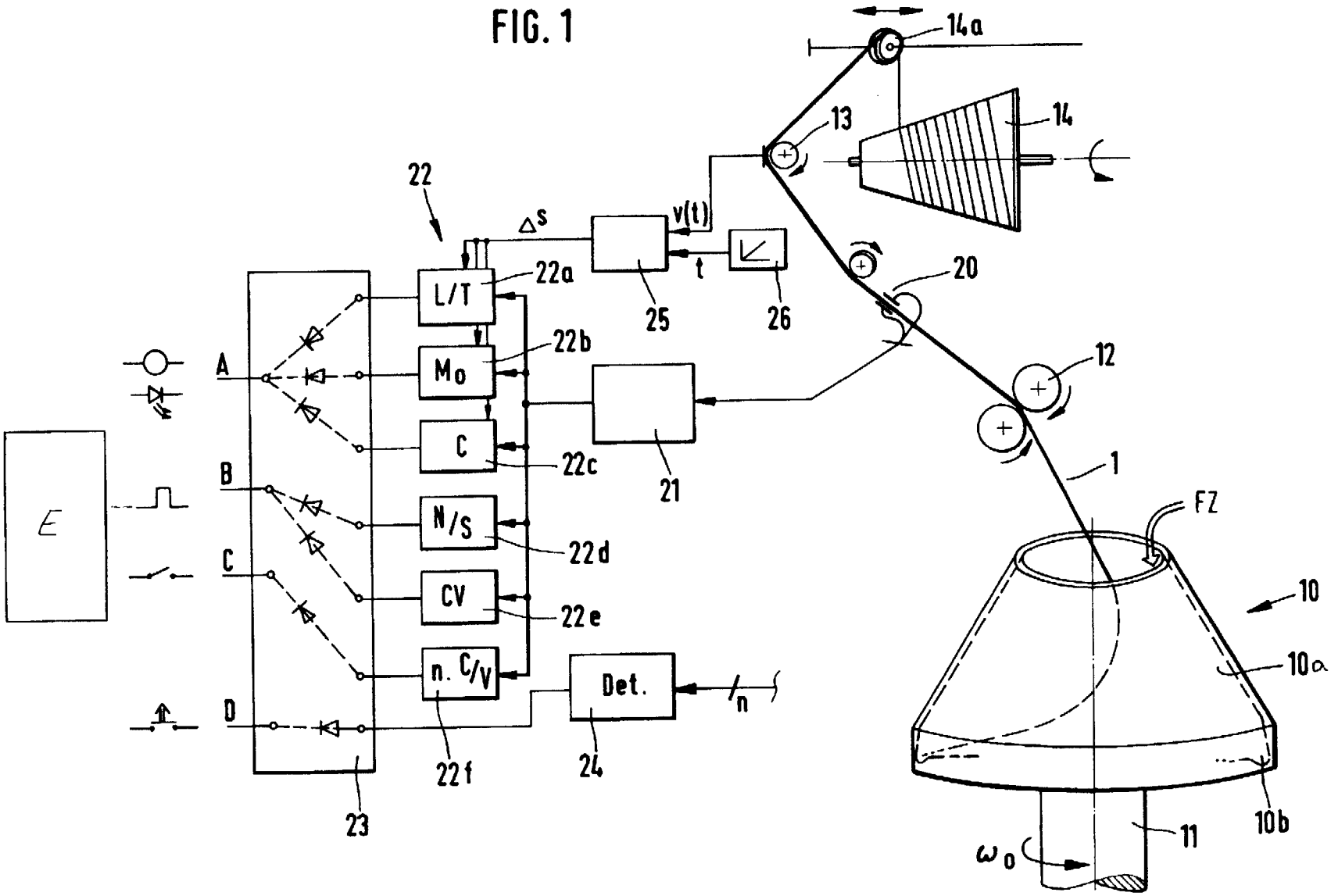

Reference will now be made in detail to the presently preferred embodiments of the invention, one or more examples of which are illustrated in the drawing. Each example is provided by way of explanation of the invention, and not as a limitation of the invention.

The sole figure shows in part schematically a rotor 10 from which a yarn 1 is withdrawn at high speed via draw-off rollers 12. The fiber feed, through which the fibers of a fiber sliver opened by an opener roller are fed, is identified schematically by FZ. This part of the spinning station is however of secondary importance here and is therefore not discussed in great detail. The geometry of the yarn or thread course is also of secondary importance and is shown only schematically in the FIGURE.

The yarn, which is twisted into itself as it is withdrawn and is then conveyed via a traversing device 14a on a winding bobbin 14, is formed in the rotor 10 in the fiber collection groove **10*b* at the high rotational speed imparted to the rotor via drive shaft 11. A measuring device 20, which may consist of a capacitor through which the drawn-off yarn runs may be installed before or after the draw-off rollers 12. Device 20 is used to measure the current yarn thickness d(t) via yarn mass or, alternatively, via an optical detection system. A pressure roller 13** can be used to detect the speed v(t).

The measuring device 20 is connected electrically to an evaluation step 21 which edits the signals of the thickness-measuring device 20 and amplifies them if necessary. Interference signals can be filtered out as early as at this stage, but it is also possible to effect only an amplification of the measuring signal.

The evaluation step 21 feeds a bus to which a plurality of error-detection elements **22*a*, 22*b*, 22*c* . . . 22*f* are connected. Each of these detection elements (hereinafter 22 for short) represents an individual type of error in the yarn. Thus, for example, the error identification 22*a* may recognize an L/T error of the measuring signal on the bus immediately and clearly. The error detection 22*d* may recognize an N or an S error for example, which may signify a short thick spot or a very short thick spot in the yarn. Excessive irregularity in the yarn, caused by errors in the opener roller, the feed roller, or the draw-off rollers 12 can be recognized by the CV error recognition element 22*e* from the bus signal of the evaluating unit 21. The Nm value is observed by the C monitor 22*c*. Moire errors are identified by the element 22*b***.

If error identifiers 22 are realized by program technology, the hardware solution of the FIGURE working in parallel yields a sequence of the software identifier in the program, all of which are however fed the same measuring signal d(t). The sub-programs 22, each of which identifies one error, correspond advantageously to the identifiers 22 for which purpose they are called up by a distributor—also at variable frequencies, depending on the importance of the error or on the speed at which the error must be recognized.

In addition to error recognition tasks in the bus signal, other mechanical or electrical errors which cannot be detected via a measuring head 20 can also be fed via a unit 24. These errors nevertheless have an influence on the functioning of the spinning station, possibly even such a considerable influence that the spinning station must be switched off when certain components have malfunctioned or when certain measuring or monitoring functions are no longer operational.

All the individualized malfunctions—each constituting an individual error at the spinning station—are grouped in an attribution unit 23. Four groups A, B, C, and D are represented as examples, each corresponding to a malfunction hierarchy. Thus the error group A is represented as an error group emitting an optical signal. The error group B is attributed to an electrically transmitted signal. Robot units (travelling automatic devices) can be informed by this signal for example, to check the spinning station as soon as possible or to initiate a new yarn piecing operation. These attribution A→optical or B→electrical are however examples in character. It is understood that the signalling of error group A can certainly also be carried out electrically, just as the electric signalling of error group B can also be carried out optically, e.g. via glass fiber cables. In addition, acoustic signals can also be triggered.

The attribution unit 23 combines the possible malfunctions which can be transmitted by the individual recognition units 22 and attributes them to certain malfunction groups A,B, C or D. In addition, the sources of error or malfunctions which are transmitted to the mechanical system or to the electronics of the spinning station or spinning device via the error detection 24 are also attributed, and these have usually a considerable weight, so that they may be attributed to the shut-down malfunction group D. However smaller electronics or mechanical error may be caught by redundancy so that the malfunction of one of the redundantly present devices does not cause shut-down but only causes the transmission of a signal indicating a malfunction to be corrected in the near future but which is (as yet) not serious.

The attribution can be achieved in different manners. The possibility exists to attribute certain errors by means of jumpers to certain group signals A,B,C or D. A diode matrix may also be used (shown schematically in the FIGURE). Another possibility consists in programming technique, by which the storage cells representing a given error signal are connected. Finally there is the possibility of using discrete logic, where a plurality of AND gates and at least two inputs are used, whereby one input is attributed to an output of an error identifier 22, **22*b*** and the other input is attributed to a control signal, indicating whether this AND gate is to be actuated. The outputs of all AND gates are connected via OR gates in such a manner that the error output A for example is connected to a certain number of AND gates which constitute this error group.

In the example the attributions of the error identifier **22*a* to 22*e* are selected so that they define two groups, i.e. group A, which enables optical display, and group B which transmits an electrical signal to a travelling robot unit (automatic carriage). These two hierarchies of error attribution may also be considered as if they constituted two sub-groups of a global group of yarn errors (long or short yarn errors). In that case all error identifiers 22*a* to 22*e*** are attributed to one malfunction group (the malfunction group of the yarn errors) and within this yarn error—malfunction group another sub-grouping is made into the two shown optically or electrically displaying error signals.

The dash-dot lines indicate the variability of the attribution of the error signals to the group output signals.

A shut-down signal D by which the spinning station is completely shut down is shown as the highest signal in its hierarchy. Those errors which, although they are to be corrected locally, nevertheless require the intervention of a qualified specialist may be attributed to this output D (shut-down of the spinning station).

An optical error display at output A was mentioned. This may be a viewing screen, it may be LED displays which can vary in form and blinking frequency, it may however also be a printer which prints out the message of a defined malfunction which was not too important and only needs to be reported, e.g. a short yarn thickness error which corrected itself.

In addition to the three outputs shown as examples, additional outputs may be provided, e.g. an output C which blocks the spinning station by producing a yarn breakage artificially thus closing this spinning station for the travelling automatic carriage. This may result in a recorded message indicating that the proper maintenance personnel must be informed.

The individual errors of the error identifiers in the drawing shall now be mentioned briefly; **22*a* identifies the L/T errors which concern thick spots or thin spots and are a summary of the long errors. The error identification 22*b* identifies moire errors which are produced when the yarn has a varying thickness at a certain repeat frequency. The C-yarn monitor is the stationary thickness monitor and is filtered out of the bus signal together with error identifier 22*c* by the evaluation step 21**. These three errors given as examples are grouped together into an error group A which triggers an optical signal, e.g. to the operator of the spinning machine, so that he may eliminate an easily corrected error himself within the limits of his technical horizon. Such an error may be the cleaning of the rotor, following which piecing may be effected again. The replacement of a bobbin or of the presented sliver is also possible. With the proper outfitting of the travelling automatic carriage, automated error elimination can also be carried out through this hierarchy.

The N/S yarn errors and the CV yarn errors are grouped together in error group B. The N/S errors are the short errors, and comprise the short and very short thick spots. Furthermore, the CV errors which designate the substantial irregularities of long duration in the yarn thickness are assigned to the error group B. These may be produced by malfunctions in the opener roller, in the feed roller, or in the draw-off roller. For this, personnel with considerable qualifications are required because a high degree of precision is necessary when changing or replacing rollers, and the person or automatic carriage correcting the errors of error group A no longer have sufficient technical knowledge or mechanical possibilities. For this reason a mechanical engineer may be called for error group B, but it is also possible to call up the travelling automatic carriage E by means of an electric signal in order to carry out certain tests so as to manage possibly without a mechanical engineer. If several piecing attempts or attempts to piece without error are unsuccessful the error signal is changed to a higher group which is schematically designated by the letter C which leads to a blockage (yarn breakage and closing for travelling carriage) of the spinning station. For example, the identifier **22*f*** recognizes n attempts to piece after a CV error.

Error group D is the one which shuts off the spinning station completely. In this case a considerable error which cannot be eliminated by simple means has occurred, so that the machine manufacturer must be informed. An example for this is a damaged measuring head 20, when no second, redundant measuring head has been provided. Another example would be failure of the length measuring system 25.

An advantageous hierarchy of error reactions and a corresponding attribution to error groups would be the following:

1. Attempt of the automatic carriage to eliminate the yarn error by yarn breakage and new piecing, possibly cleaning (error group A).
2. Call up operator for correction of error (error group B), in particular when 1. has been unsuccessful.
3. Inform specialized personnel or mechanical engineer (error group C), in particular when 2. has been unsuccessful. The spinning station is then blocked.
4. Inform machine manufacturer or group leader (error group D).

Any unsuccessful attempt to eliminate an error automatically leads to a climb in the hierarchy, as is indicated above by "in particular." Thus a piecing attempt by the automatic carriage followed by continued error (group A) will lead to an error message transmitted to the operator (group B).

It is obvious that the error identifiers 22, 24 shown in the drawing which transmit messages on malfunctions (yarn errors, machine malfunctions, electronics errors) may not only be discrete but may also be contained in a signal processor or microcomputer where certain error detection routines (sub-programs) can be interrupt-controlled or can run repeatedly in the main program. The interrupt routines then constitute the error or malfunction identifiers because they carry out their functions, functions which can however not be shown in a drawing.

To improve error recognition, e.g. in the group of yarn errors, additional measuring parameters such as speed v(t) or yarn length s(t) or differential yarn length s and limit values or tolerance ranges which can be adjusted may be used. In order to detect these "additional parameters" of the moving yarn, a speed measurement can be provided which is drawn schematically as the slip-free slaving roller 13. The timer 26 enables the converter 25 to find the yarn length s from the measuring signal v of the speed measurement device 13. Alternatively, the number of rotations of roller 13 can be counted, the roller circumference being known. The signal s can be evaluated by means of the program or in the discrete error identifiers *22a*, *22b*, . . . .

It will be apparent to those skilled in the art that various modifications and variations can be made in the present invention without departing from the scope or spirit of the invention. For example, features illustrated or described as part of one embodiment may be used on another embodiment to yield a still further embodiment. It is intended that the present invention cover such modifications and variations as come within the scope of the appended claims and their equivalents.

I claim:

1. A device for qualifying errors at a spinning station of a textile machine, said device comprising:

at least one measuring device disposed and configured to measure at least one physical parameter of a moving yarn at said spinning station;

an evaluation section in communication with said measuring device, said evaluation section continuously evaluating said measured parameter of the moving yarn with respect to a plurality of predetermined yarn quality parameter criteria to produce a plurality of yarn quality error message signals based on the evaluation of the measured parameter with respect to the predetermined yarn quality parameter criteria; and an attribution section in communication with said evaluation section, said attribution section configured to receive said plurality of yarn quality error message signals in parallel and to attribute said error message signals to predetermined error groups for subsequent corrective action assigned to each respective said error group to correct said yarn quality error message signals.

2. The device as in claim 1, wherein said at least one measuring device is disposed in the running course of the yarn between the withdrawal point of a spinning rotor and a winding device of the textile machine.

3. The device as in claim 1, wherein said attribution section further categorizes said error groups by message hierarchy, each message within said hierarchy having a respective said corrective action assigned thereto.

4. The device as in claim 3, wherein one said message within said message hierarchy causes blockage of the spinning station.

5. The device as in claim 3, wherein one said message within said message hierarch causes stopping of the spinning station.

6. The device as in claim 3, wherein one said message within said message hierarchy causes a signal to be sent to a travelling service carriage of the textile machine for appropriate corrective action to be carried out by the travelling service carriage.

7. The device as in claim 3, wherein one said message within said message hierarchy causes complete shut down of the spinning station.

8. The device as in claim 3, wherein one said message within said message hierarchy causes blockage of the respective spinning station, one said message within said message hierarchy causes stopping of the spinning station, one said message within said message hierarchy causes a signal to be sent to a travelling service carriage of the textile machine for appropriate corrective action to be carried out by the travelling service carriage, and one said message within said message hierarchy causes complete shut down of the spinning station.

9. The device as in claim 3, wherein one said message within said message hierarchy causes an optical signal to be generated indicating the error.

10. The device as in claim 1, wherein each said error group within said attribution section is further divided into error sub-groups.

11. The device as in claim 1, wherein at least one said measuring device contains a capacitor traversed by the yarn, said capacitor configured to determine yarn thickness.

12. The device as in claim 1, wherein at least one said measuring device is configured to measure speed of the yarn.

13. The device as in claim 1, wherein at least one said measuring device is configured to measure length of the yarn.

14. A process for detecting and evaluating yarn quality errors occurring at a yarn spinning station of a textile machine, said process comprising detecting at least one measured parameter of the running yarn at the textile machine; evaluating the measured parameter with respect to predetermined yarn quality parameter criteria; generating a plurality of yarn quality error messages upon sensing yarn quality errors as a result of the evaluation; attributing the plurality of error messages in parallel to predetermined error groups corresponding to a hierarchy of automatic graduated corrective actions suitable for the respective error groups; and carrying out the automatic corrective action of the respective error group for each error message to correct the yarn quality errors.

15. The process as in claim 14, further comprising defining the attribution between errors and the error groups on the basis of any combination of machine characteristics, user characteristics, and operation characteristics.

16. The process as in claim 14, wherein the carrying out of the automatic corrective action includes any combination of calling up an automatic travelling carriage, generating an optical signal for manual error elimination, blocking the respective spinning stations, shutting down the respective spinning station, and informing the machine manufacturer for one of the error groups is performed.

17. The process as in claim 14, further comprising attributing the error message to the next highest hierarchy error group after more than one unsuccessful attempt to eliminate the error at the lower hierarchy error group.

* * * * *